US009970689B2

(12) United States Patent
Schutte et al.

(10) Patent No.: US 9,970,689 B2
(45) Date of Patent: May 15, 2018

(54) COOLING SYSTEM HAVING A CONDENSER WITH A MICRO-CHANNEL COOLING COIL AND SUB-COOLER HAVING A FIN-AND-TUBE HEAT COOLING COIL

(71) Applicant: Liebert Corporation, Columbus, OH (US)

(72) Inventors: Daniel J. Schutte, Lewis Center, OH (US); Matthew Raven, Columbus, OH (US); Benedict J. Dolcich, Westerville, OH (US); Zhiyong Lin, Dublin, OH (US)

(73) Assignee: Liebert Corporation, Columbus, OH (US)

( * ) Notice: Subject to any disclaimer, the term of this patent is extended or adjusted under 35 U.S.C. 154(b) by 80 days.

(21) Appl. No.: 14/855,486

(22) Filed: Sep. 16, 2015

(65) Prior Publication Data

US 2016/0084539 A1 Mar. 24, 2016

Related U.S. Application Data

(60) Provisional application No. 62/053,297, filed on Sep. 22, 2014.

(51) Int. Cl.
*F25B 40/02* (2006.01)
*F25B 13/00* (2006.01)
(Continued)

(52) U.S. Cl.
CPC ..... *F25B 13/00* (2013.01); *F25B 23/006* (2013.01); *F25B 39/02* (2013.01); *F25B 39/04* (2013.01);
(Continued)

(58) Field of Classification Search
CPC ..... F25B 13/00
See application file for complete search history.

(56) References Cited

U.S. PATENT DOCUMENTS 5,457,964 A * 10/1995 Hyde ..... F25B 39/04 62/196.3
5,771,700 A * 6/1998 Cochran ..... F25B 13/00 62/117
(Continued)

FOREIGN PATENT DOCUMENTS

EP 1923123 A2 5/2008
EP 2685176 A1 * 1/2014 ..... F25B 29/003
EP 2685176 A1 1/2014

OTHER PUBLICATIONS

Steven Wand, Microchannel Coils Add Dimension for Cooling Systems, Jan./Feb. 2014, Process Cooling & Equipment, p. 20-23.*
(Continued)

*Primary Examiner* — Len Tran
*Assistant Examiner* — Jenna M Hopkins
(74) *Attorney, Agent, or Firm* — Harness, Dickey & Pierce, P.L.C.

(57) ABSTRACT

In an aspect, a cooling system has a cooling circuit that includes an evaporator, a condenser, a compressor, a sub-cooler and an expansion device configured in a direct expansion cooling circuit with the sub-cooler coupled in series between an outlet of the condenser and an inlet of the expansion device. The condenser has a micro-channel cooling coil and the sub-cooler has a fin-and-tube cooling coil. In an aspect, the fin-and-tube cooling coil of the sub-cooler has a total hydraulic volume equivalent to the total hydraulic volume of the micro-channel cooling coil of the condenser but the fin-and-tube cooling coil of the sub-cooler has a face
(Continued)

area more than two times smaller than a face area of the micro-channel cooling coil of the condenser.

4 Claims, 3 Drawing Sheets

(51) Int. Cl.
*F25B 39/02* (2006.01)
*F25B 23/00* (2006.01)
*F25B 39/04* (2006.01)
*F25B 6/04* (2006.01)

(52) U.S. Cl.
CPC ..... *F25B 40/02* (2013.01); *F25B 6/04* (2013.01); *F25B 2339/04* (2013.01); *F25B 2400/0401* (2013.01)

(56) References Cited

U.S. PATENT DOCUMENTS 6,170,272 B1 * 1/2001 Backman ..... F25B 5/02 62/117
6,662,576 B1 * 12/2003 Bai ..... F25B 43/00 62/117
8,006,503 B2 * 8/2011 Collins ..... B01D 53/265 62/93
8,695,375 B2 4/2014 Kirkwood
2002/0189280 A1 * 12/2002 Taira ..... C09K 5/045 62/502
2004/0134426 A1 7/2004 Tomoyasu
2009/0025405 A1 * 1/2009 Yanik ..... F25B 40/00 62/117
2009/0241573 A1 * 10/2009 Ikegami ..... B60H 1/00335 62/238.7
2010/0326103 A1 * 12/2010 Stamm ..... F24F 3/1405 62/176.6
2011/0185757 A1 * 8/2011 Bittner ..... A47F 3/04 62/216
2013/0061615 A1 * 3/2013 Omer ..... F24F 13/222 62/82
2013/0098085 A1 * 4/2013 Judge ..... H05K 7/20827 62/180
2013/0098088 A1 * 4/2013 Lin ..... F25B 49/02 62/228.1
2013/0175016 A1 7/2013 Steele et al.
2013/0219932 A1 * 8/2013 David ..... F25B 39/04 62/115
2013/0312441 A1 11/2013 Fritz
2014/0109605 A1 * 4/2014 Qu ..... F25B 49/02 62/118
2014/0116068 A1 * 5/2014 Uselton ..... F25B 21/02 62/3.2
2014/0260387 A1 * 9/2014 Takenaka ..... F24F 3/065 62/205
2014/0260390 A1 * 9/2014 Pham ..... F25B 45/00 62/228.1
2015/0143835 A1 * 5/2015 Matsumoto ..... F25B 40/02 62/324.1
2016/0098085 A1 * 4/2016 Weddle ..... G05D 1/005 345/156
2016/0146496 A1 * 5/2016 Yamashita ..... F25B 13/00 62/190

OTHER PUBLICATIONS

Steven Wand, Microchannel Coils Add Dimension for Cooling Systems, Jan./Feb. 2014, Process Cooling&Equipment, p. 20-23.*
International Search Report and Written Opinion for PCT/US2015/051150, dated Dec. 15, 2016.
"Microchannel Technology, More Efficient, Compact and Corrosion Resistant Technology for Air Cooled Chiller Applications" Carrier Corporation, Apr. 2006.

* cited by examiner

COOLING SYSTEM HAVING A CONDENSER WITH A MICRO-CHANNEL COOLING COIL AND SUB-COOLER HAVING A FIN-AND-TUBE HEAT COOLING COIL

This application claims the benefit of U.S. Provisional Application No. 62/053,297 filed on Sep. 22, 2014. The entire disclosure of the above application is incorporated herein by reference

FIELD

The present disclosure relates to cooling systems, and more particularly, to a cooling system having a condenser with a micro-channel cooling coil and a sub-cooler with a fin-and-tube cooling coil.

BACKGROUND

This section provides background information related to the present disclosure which is not necessarily prior art.

Cooling systems have applicability in a number of different applications where fluid is to be cooled. They are used in cooling gas, such as air, and liquids, such as water. Two common examples are building HVAC (heating, ventilation, air conditioning) systems that are used for "comfort cooling," that is, to cool spaces where people are present such as offices, and data center climate control systems.

A data center is a room containing a collection of electronic equipment, such as computer servers. Data centers and the equipment contained therein typically have optimal environmental operating conditions, temperature and humidity in particular. Cooling systems used for data centers typically include climate control systems, usually implemented as part the control for the cooling system, to maintain the proper temperature and humidity in the data center.

An example of a prior art cooling system is the DSE™ cooling system product line available from Liebert Corporation of Columbus, Ohio. FIG. 3 is a basic schematic showing an example configuration of a DSE™ cooling system 300. Cooling system 300 includes a direct expansion ("DX") cooling circuit 302 having an evaporator 304, expansion valve 306 (which may preferably be an electronic expansion valve but may also be a thermostatic expansion valve), condenser 308 and compressor 310 arranged in a DX refrigeration circuit. Cooling circuit 302 also includes a pump 312, solenoid valve 314, check valves 316, 318 and 320, and receiver/surge tank 324. An outlet 328 of condenser 308 is coupled to an inlet 326 of receiver/surge tank 324. An outlet 330 of receiver/surge tank 324 is coupled to inlet 334 of pump 312 and to inlet 336 of check valve 316. An outlet 344 of pump 312 is coupled to an inlet 346 of solenoid valve 314. An outlet 348 of solenoid valve 314 is coupled to an inlet 350 of electronic expansion valve 306. An outlet 352 of check valve 316 is also coupled to the inlet 350 of electronic expansion valve 306. An outlet 354 of electronic expansion valve 306 is coupled to a refrigerant inlet 356 of evaporator 304. A refrigerant outlet 358 of evaporator 304 is coupled to an inlet 360 of compressor 310 and to an inlet 362 of check valve 318. An outlet 364 of compressor 310 is coupled to an inlet 366 of check valve 320 and an outlet 368 of check valve 320 is coupled to an inlet 370 of condenser 308 as is an outlet 372 of check valve 318.

Cooling system 300 also includes a controller 374 coupled to controlled components of cooling system 300, such as electronic expansion valve 306, compressor 310, pump 312, solenoid valve 314, condenser fan 378, and evaporator air moving unit 332. Controller 374 is illustratively programmed with appropriate software that implements the control of cooling system 300. Controller 374 may include, or be coupled to, a user interface 376. Controller 374 may illustratively be an iCOM® control system available from Liebert Corporation of Columbus, Ohio programmed with software implementing the control of cooling system 300 including the additional functions described below. In this regard, controller 374 may be programmed with software implementing the control described in U.S. Ser. No. 13/446,310 for "Vapor Compression Cooling System with Improved Energy Efficiency Through Economization" filed Apr. 13, 2012. The entire of disclosures of U.S. Ser. No. 13/446,310 is incorporated herein by reference.

Pump 312 may illustratively be a variable speed pump but alternatively may be a fixed speed pump. Condenser fan 378 may illustratively be a variable speed fan but alternatively may be a fixed speed fan. It should be understood solenoid valve 314 could be types of controlled valves other than solenoid valves, such as a motorized ball valve or variable flow valve.

It should be understood that pump 312, solenoid valve 314 and check valve 316 are basic elements of an optional unit in the DSE™ product line known as the ECONOPHASE™ unit, identified in phantom in FIG. 3 with reference number 380, having an inlet 382 at a junction of inlet 334 of pump 312 and inlet 336 of check valve 316 and an outlet 384 at a junction of outlet 348 of solenoid valve 314 and outlet 352 of check valve 316. It should thus be understood that cooling system 300 can be configured without ECONOPHASE™ unit 380 with the outlet 330 of receiver/surge tank 324 coupled to the inlet 350 of electronic expansion valve 306.

In the DSE™ product line, condenser 308 is a micro-channel condenser. That is, condenser 308 has one or more micro-channel cooling coils referred to herein as micro-channel cooling coil 309. Evaporator 304 is a fin-and-tube evaporator. That is, evaporator has one or more fin-and-tube cooling coils referred to herein as fin-and-tube cooling coil 305. As is known in the art, a typical fin-and-tube cooling coil has rows of tubes (usually copper) that pass through sheets of formed fins (usually aluminum). The rows of tubes may be one or more tubes having a serpentine configuration that snakes back and forth. Also as known in the art, a typical micro-channel cooling coil has a series of parallel flat micro-channel tubes extending between inlet and outlet manifolds with fins extending between the adjacent micro-channel tubes. Each micro-channel tube has a series of micro-channels therein extending the length of the tube. A micro-channel is typically defined as a channel (flow passage) with a hydraulic diameter in the range of 10 to 1000 micrometers.

Micro channel cooling coils offer many benefits compared to tube and fin cooling coils. Low internal refrigerant volume and smaller footprint are among them. The low internal refrigerant volume means that the micro-channel cooling coil holds much less refrigerant charge than an equivalent sized tube-and fin cooling coil. While this is beneficial from a cost standpoint, it causes an issue in the operation of the system. The low amount of refrigerant causes the system to be very sensitive to the total amount of system refrigerant charge. Small amounts of charge difference can equate to significant changes in sub-cooling due to the amount of liquid refrigerant in the condenser and the low volume of refrigerant relative to the coil face area. Also, if the volume of the evaporator is large relative to the volume of the condenser, this creates an issue with migration of charge and how the system handles this charge during a change in ambient temperatures of the evaporator and/or the condenser. For example, when the ratio of the evaporator volume (the volume of refrigerant charge that the fin-and tube cooling coil of evaporator holds) to condenser volume (the volume of refrigerant charge that the micro-channel cooling coil of the condenser holds) is greater than 2.5, there may be issues with charging of the system. If the system is charged with refrigerant when cold outside (at condenser) and warm inside (at evaporator) the system will be overcharged when run with an opposite swing in temperatures (cold indoor and warm outdoor). In this scenario, refrigerant migration will result in high discharge pressures and very likely trip the high pressure cut-out safety device. In the opposite case, if the unit were charged when cold inside (at evaporator) and warm outside (at condenser), the unit will lose its sub-cooling when run at the opposite conditions (warm indoor and cold outdoor) such that capacity and efficiency will be significantly reduced.

To address the above discussed refrigeration migration charge issue, a large receiver/surge tank 324 has been added on the discharge side of condenser 308 to allow for migration of refrigerant. This receiver/surge tank 324 is required due to the relative difference between the volume of condenser 308 and the volume of evaporator 304 as the volume of condenser 308 is small relative to the volume of evaporator 304. It was determined that when the ratio of the volume of evaporator 304 to condenser 308 is greater than 2.5, cooling system 300 system may not be able to function properly throughout the required range of operation (outdoor air temperature between −30° F. and 105° F. and return air temperature to the evaporator between 68° F. and 105° F.). Receiver/surge tank 324 was thus added at the discharge of condenser 308 to hold additional volume of refrigerant. However, when a receiver/surge tank is added to the system, sub-cooling of refrigerant out of the condenser is lost with a corresponding loss of efficiency and capacity.

SUMMARY

This section provides a general summary of the disclosure, and is not a comprehensive disclosure of its full scope or all of its features.

In accordance with an aspect of the present disclosure, a cooling system has a cooling circuit that includes an evaporator, a condenser, a compressor, a sub-cooler and an expansion device configured in a direct expansion cooling circuit with the sub-cooler coupled in series between an outlet of the condenser and an inlet of the expansion device. The condenser has a micro-channel cooling coil and the sub-cooler has a fin-and-tube cooling coil. The evaporator has a fin-tube cooling coil. In an aspect, the fin-and-tube cooling coil of the sub-cooler has a total hydraulic volume equivalent to the total hydraulic volume of the micro-channel cooling coil of the condenser but the fin-and-tube cooling coil of the sub-cooler having a face area more than two times smaller than a face area of the micro-channel cooling coil of the condenser. That is, the face area of the fin-and-tube cooling coil of the sub-cooler is less than one-half the face area of the micro-channel cooling coil of the condenser.

In an aspect, the cooling system also includes a liquid pump coupled in series between an outlet of the sub-cooler and an inlet of the expansion device and has a direct expansion mode wherein the compressor is on and compresses a refrigerant in a vapor phase to raise its pressure and thus its condensing temperature and refrigerant is circulated around the cooling circuit by the compressor. The cooling system also has a pumped refrigerant economizer mode wherein the compressor is off and the liquid pump is on and pumps the refrigerant in a liquid phase and refrigerant is circulated around the cooling circuit by the liquid pump and without compressing the refrigerant in its vapor phase.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
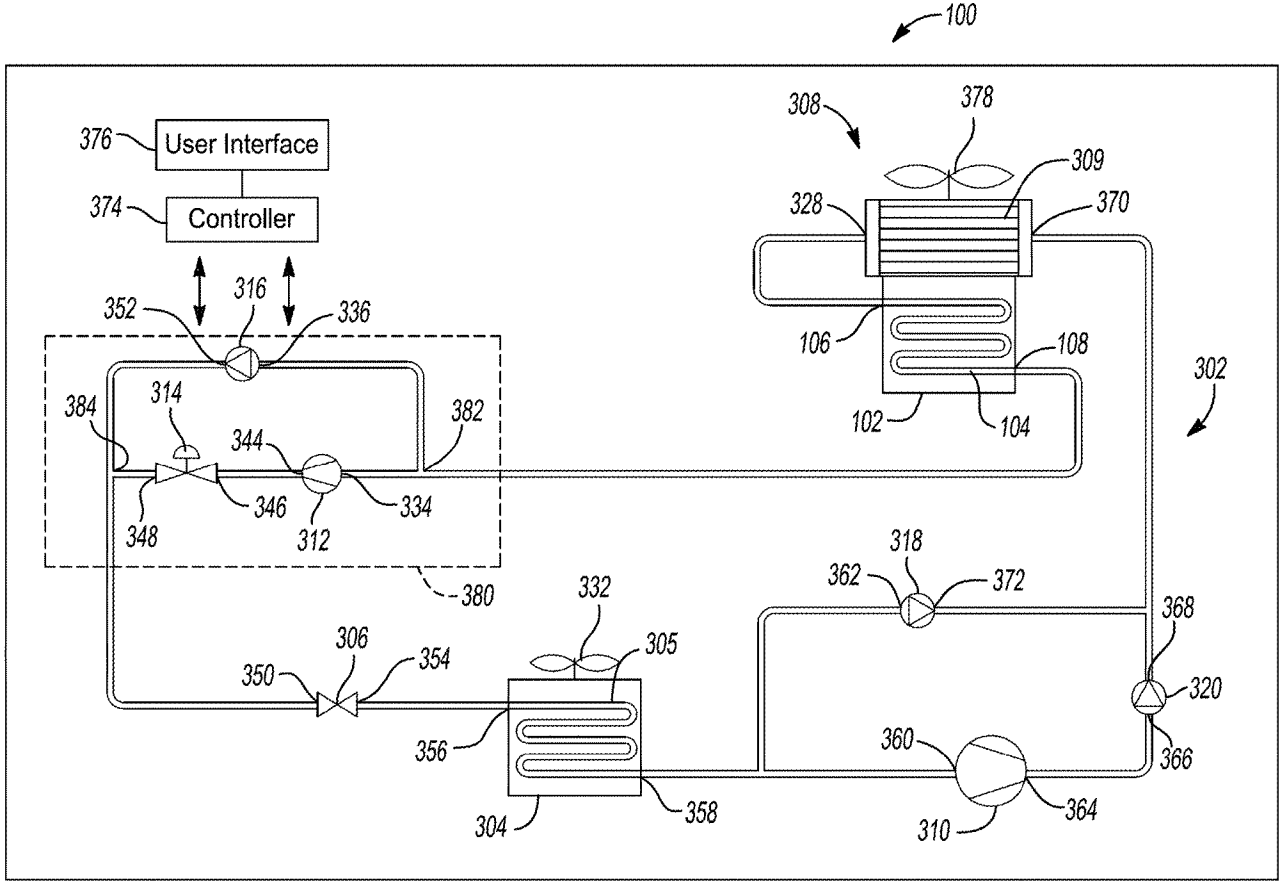
FIG. 1 is a basic schematic of a cooling system in accordance with an aspect of the present disclosure.

FIG. 1 is a basic schematic of a cooling system 100 in accordance with an aspect of the present disclosure. Cooling system 100 is the same as cooling system 300 with the exception that receiver/surge tank has been eliminated and a sub-cooler 102 added that has one or more fin-and-tube cooling coils, collectively referred to as fin-and-tube cooling coil 104. An inlet 106 of sub-cooler 102 is coupled to outlet 328 of condenser 308 and an outlet 108 of sub-cooler 102 coupled to inlet 382 of ECONOPHASE™ unit 380, or to inlet 350 of electronic expansion valve 306 if cooling system 100 does not have the optional ECONOPHASE™ unit 380. Sub-cooler 102 is thus coupled in series between outlet 328 of condenser 308 and inlet 350 of electronic expansion valve 306. If cooling system 100 has the optional ECONOPHASE™ unit 380, ECONOPHASE™ unit 380 is coupled in series between the outlet 108 of sub-cooler 102 and the inlet 350 of electronic expansion valve 306 with an outlet 384 of ECONOPHASE™ unit 380 coupled to inlet 350 of electronic expansion valve 306.

In an aspect, the fin-and-tube cooling coil 104 of sub-cooler 102 has a total hydraulic volume equivalent to the total hydraulic volume of the micro-channel cooling coil 309 but with the fin-and-tube cooling coil of sub-cooler 102 having a face area more than two times smaller than a face area of the micro-channel cooling coil 309. The face area in each instance is the face area of the fins of the respective cooling coil.

Figure 2:
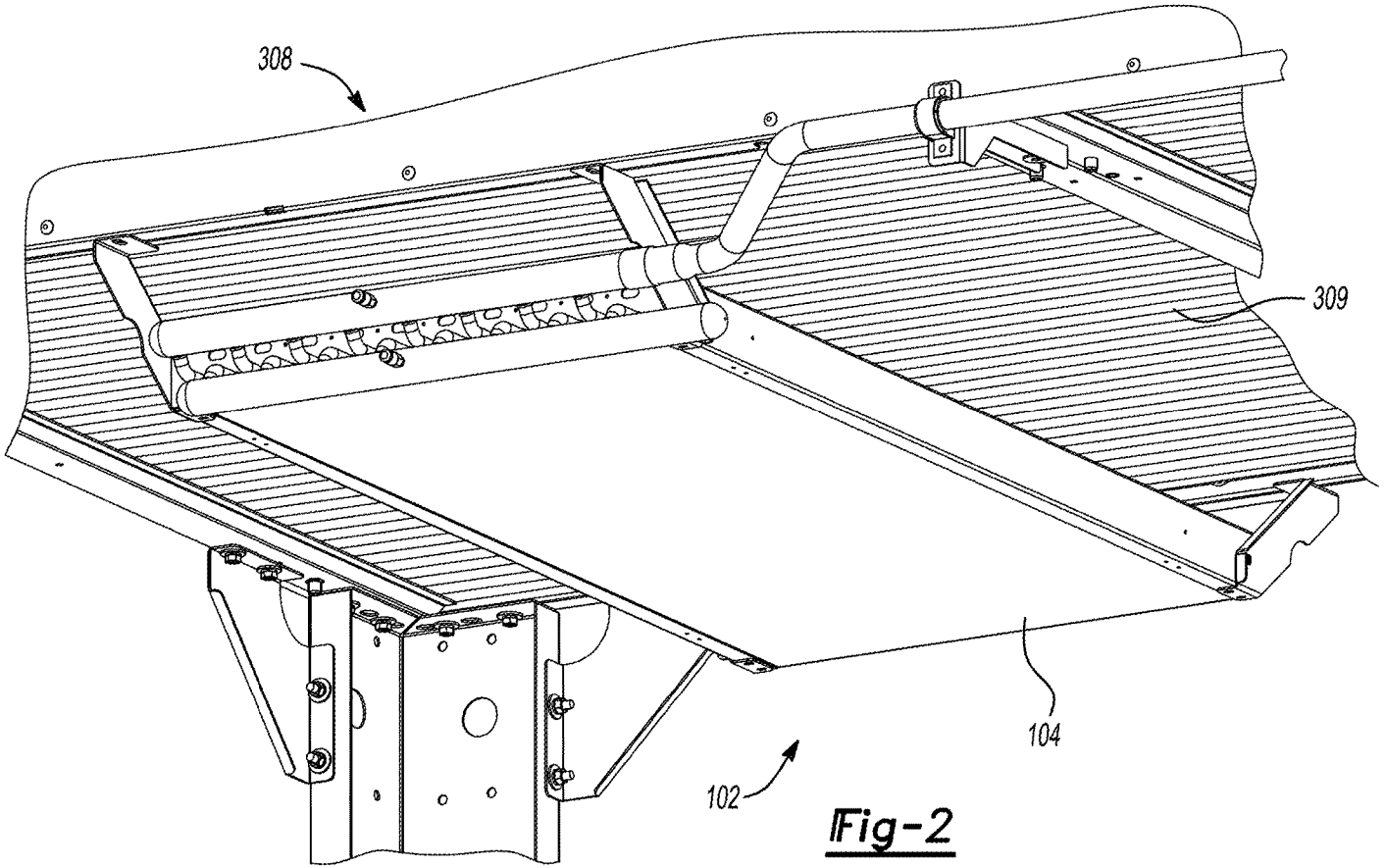
FIG. 2 is a perspective view of a portion of a condenser of the cooling system of FIG. 1 showing the sub-cooler mounted beneath the micro-channel cooling coil of the condenser.
Figure 3:
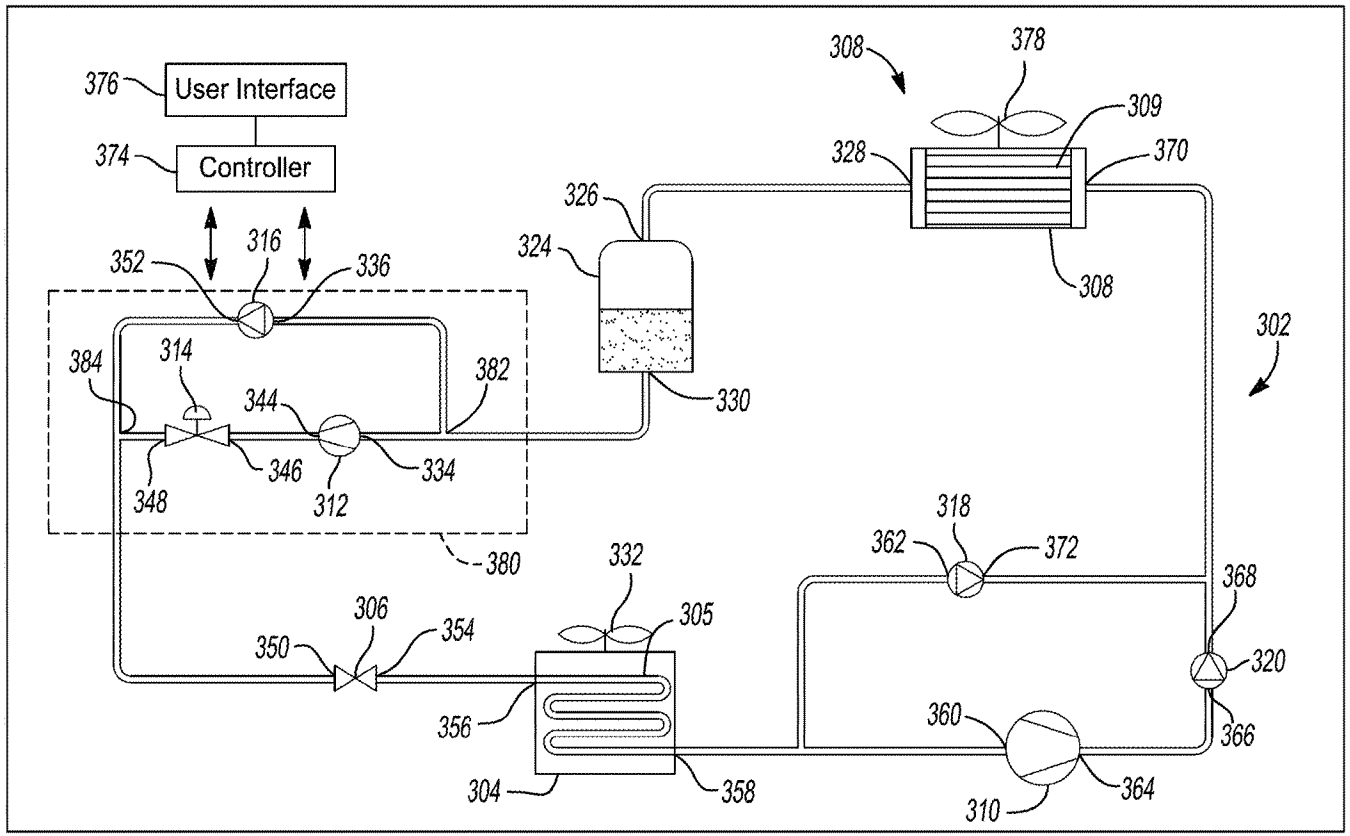
Fig-3 PRIOR ART
FIG. 3 is a basic schematic of a prior art cooling system.

In an aspect, sub-cooler 102 is mounted beneath micro-channel cooling coil 309 of condenser 308, as shown in FIG. 2, so that condenser fan 378 blows air across fin-and-tube cooling coil 104 of sub-cooler 102 as well as micro-channel cooling coil 309 of condenser 308.

A fin-and-tube cooling coil is less sensitive to refrigerant charge differences compared to a micro-channel cooling coil because of fin-and-tube's larger internal volume relative to its face area. A sub-cooler having a fin-and-tube cooling coil used after a micro-channel condenser allows most of the liquid refrigerant in the condenser to reside in the fin-and-tube cooling coil of the sub-cooler instead of the micro-channel coil of the condenser. Variation of refrigerant charge leads to differences of liquid refrigerant in the find-and-tube cooling coil of the sub-cooler instead of in the more sensitive micro-channel cooling coil of the condenser. This makes the condenser (and the entire system) less sensitive to the amount of refrigerant charge as the fin-and-tube cooling coil of the sub-cooler contains the sub-cooled liquid refrigerant and the micro-channel cooling coil of the condenser can still make use of its finned area for heat exchange. Without the fin-and-tube cooling coil of the sub-cooler, liquid can back up in the micro-channel cooling coil of the condenser effectively reducing the finned area for heat exchange. This results in higher discharge pressure at the condenser which decreases compressor efficiency and capacity. Adding a fin-and-tube sub-cooler to the discharge side of the refrigerant circuit, (outlet of condenser) and the inlet side of the airstream (upstream side of the micro-channel cooling coil), in place of a receiver, allows the cooling system to function throughout extreme ambient operating conditions (essentially the same as using a receiver) but increases efficiency of the cooling system as well as the cooling system capacity (increases output capacity of the cooling system while having very minimal impact on input power) which results in a net increase in efficiency (seasonal coefficient of performance or SCOP). Adding the fin-and-tube sub-cooler to the discharge side of the refrigerant circuit, (outlet of condenser) and the inlet side of the airstream, in place of a receiver, is particularly advantageous in cooling systems described in the Background of the present application where the volume of the evaporator is large relative to the volume of the condenser, such as when the ratio of the evaporator volume (the volume of refrigerant charge that the fin-and tube cooling coil of evaporator holds) to condenser volume (the volume of refrigerant charge that the micro-channel cooling coil of the condenser holds) is greater than 2.5.

In an aspect, the micro-channel cooling coil 309 of the condenser and the fin-and-tube cooling coil 104 of the sub-cooler 102 are configured so that the fin-and-tube cooling coil 104 of the sub-cooler 102 holds the majority of the liquid refrigerant charge of the condenser. As used herein, the liquid refrigerant charge of the condenser is the combined volume of liquid refrigerant charge in the micro-channel cooling coil and liquid refrigerant charge in the fin-and-tube cooling coil of the sub-cooler. For example, the fin-and-tube cooling coil 104 of sub-cooler 102 holds at least 70% of the liquid refrigerant charge of the condenser with the micro-channel cooling coil holding the remaining liquid refrigerant charge and the remaining volume of the micro-channel cooling cool then holding vapor refrigerant charge.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A cooling system, comprising:

an evaporator having a fin-and-tube cooling coil, a condenser having a micro-channel cooling coil, a compressor, a sub-cooler having a fin-and-tube cooling coil and an expansion device configured in a direct expansion cooling circuit with the sub-cooler coupled in series between an outlet of the condenser and an inlet of the expansion device, the fin-and tube cooling coil of the evaporator and the micro-channel cooling coil of the condenser configured so that the fin-and-tube cooling coil of the evaporator has a volume that is greater than 2.5 times a volume of the microchannel cooling coil of the condenser, the fin-and-tube cooling coil of the sub-cooler and the micro-channel cooling coil of the condenser are configured so that the fin-and-tube cooling coil of the sub-cooler holds a majority of a liquid refrigerant charge of the condenser and the micro-channel cooling coil of the condenser holds a remainder of the liquid refrigerant charge and any remaining volume of the micro-channel cooling coil holds a vapor refrigerant charge.

2. The cooling system of claim 1 wherein the micro-channel cooling coil and the fin-and tube cooling coil arranged so that the fin-and-tube cooling coil is upstream of the micro-channel cooling coil in a cooling airstream blown by a condenser fan across the fin-and-tube cooling coil as well as the micro-channel cooling coil, the fin-and-tube cooling coil of the sub-cooler has a total hydraulic volume equivalent to a total hydraulic volume of the micro-channel cooling coil of the condenser and the fin-and-tube cooling coil of the sub-cooler has a face area that is less than one-half a face area of the micro-channel cooling coil of the condenser.

3. The cooling system of claim 1 wherein the cooling circuit further includes a liquid pump coupled in series between an outlet of the sub-cooler and an inlet of the expansion device, the cooling system having a direct expansion mode wherein the compressor is on and compresses a refrigerant in a vapor phase to raise its pressure and thus its condensing temperature and refrigerant is circulated around the cooling circuit by the compressor, the cooling system also having a pumped refrigerant economizer mode wherein the compressor is off and the liquid pump is on and pumps the refrigerant in a liquid phase and refrigerant is circulated around the cooling circuit by the liquid pump and without compressing the refrigerant in its vapor phase.

4. The cooling system of claim 1 wherein the fin-and-tube cooling coil of the sub-cooler and the micro-channel cooling coil of the condenser are configured so that the fin-and-tube cooling coil of the sub-cooler holds at least seventy percent of the liquid refrigerant charge and the micro-channel cooling coil of the condenser holds the remaining refrigerant charge.

* * * * *